United States Patent [19]

Freedman

[11] 3,949,184

[45] Apr. 6, 1976

[54] FOLDING MICROWAVE SEARING AND BROWNING MEANS

[75] Inventor: George Freedman, Wayland, Mass.

[73] Assignee: Raytheon Company, Lexington, Mass.

[22] Filed: May 2, 1975

[21] Appl. No.: 574,063

[52] U.S. Cl...... 219/10.55 E; 99/DIG. 14; 426/243

[51] Int. Cl.[2]..... H05B 9/06

[58] Field of Search 219/10.55 E, 10.55 F, 10.55 M; 426/107, 237, 241, 243; 99/DIG. 14

[56] References Cited

UNITED STATES PATENTS

| | | | |
|---|---|---|---|
| 3,302,632 | 2/1967 | Fichtner | 219/10.55 E |
| 3,353,968 | 11/1967 | Kucejewski | 219/10.55 E |
| 3,490,580 | 1/1970 | Brumfield et al. | 219/10.55 E |
| 3,740,514 | 6/1973 | Anderson | 219/10.55 F |
| 3,857,009 | 12/1974 | Mac Master et al. | 219/10.55 E |

FOREIGN PATENTS OR APPLICATIONS

| | | | |
|---|---|---|---|
| 1,515,168 | 8/1969 | Germany | 219/10.55 F |

*Primary Examiner*—Arthur T. Grimley
*Attorney, Agent, or Firm*—Edgar O. Rost; Joseph D. Pannone; Herbert W. Arnold

[57] ABSTRACT

A microwave searing and browning plate is disclosed in a folding configuration for easy storage within a microwave oven apparatus. A shielding means is provided for storing the searing and browning means in the folded position as well as preventing the folded components from being responsive to the microwave energy radiated within the enclosure during a non-broiling operation mode.

2 Claims, 2 Drawing Figures

FOLDING MICROWAVE SEARING AND BROWNING MEANS

BACKGROUND OF THE INVENTION

1. Field of the Invention

The invention relates to microwave heating and utensils for producing seared and browned surfaces.

2. Description of the Prior Art

Cooking with microwave energy involves the high frequency oscillatory movement of the molecules in a load to cause heating by molecular friction. The frequency of the microwave energy is in excess of 300 MHz and the waves have wavelengths in the order of 1 meter to 1 millimeter in the electromagnetic energy spectrum. Materials heated with microwave energy have varying dielectric constant characteristics which produces a varying heating pattern. Various devices have evolved for providing seared and browned surfaces in microwave cooking. Examples of such devices may be had by referring to U.S. Letters Pat. No. 3,857,009, issued Dec. 24, 1974 to G. H. MacMaster et al. and assigned to the assignee of the present invention. In addition, reference is made to copending patent applications Ser. Nos. 554,861 filed Mar. 3, 1975 and Ser. No. 562,745 filed Mar. 27, 1975 both by G. H. MacMaster et al. and also assigned to the present assignee. All of the foregoing searing and browning devices will be utilized in combination with microwave heating apparatus. Storage of the searing and browning means can become a problem and efficient storage of such means is desirable.

SUMMARY OF THE INVENTION

In accordance with the teachings of the invention a searing and browning means similar to the structures disclosed in the referenced art may be efficiently stored within a microwave oven apparatus by means of making the structure foldable to be opened up when the heating cycle is desired. The folded apparatus is stored within conductive shield means which will reflect energy from impinging on the folded structure. The foldable structure may be rendered removable for ease in cleaning after use.

BRIEF DESCRIPTION OF THE DRAWINGS

Details of the invention will be readily understood after consideration of the following description of the illustrative embodiment and reference to the accompanying drawings wherein.

DESCRIPTION OF THE PREFERRED EMBODIMENT

Figure 1:
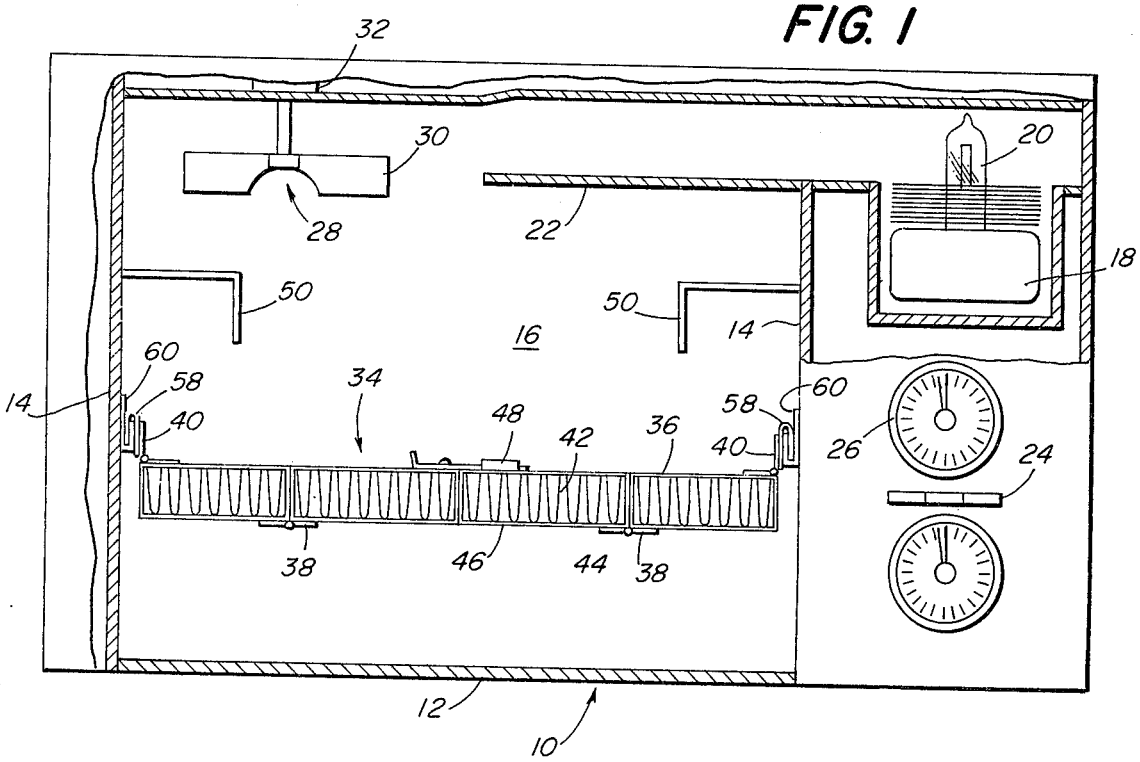
FIG. 1 is a vertical cross-sectional view of microwave apparatus embodying the invention in the open or heating position.

Referring to FIG. 1 the microwave oven apparatus 10 comprises parallel top and bottom walls 12 which together with the sidewalls 14 form the oven enclosure 16. An access opening and a door (not shown) are also provided. A microwave energy generator 18 of the well known type having an antenna 20 provides the microwave energy which is radiated through launching waveguide 22. Operation is controlled by buttons 24 and timers 26. The radiated energy is distributed by means of a mode stirrer 28 having a plurality of vanes 30 which are rotated by a motor 32.

In this embodiment the searing and browning means 34 is of the type described in copending patent application Ser. No. 554,861 filed Mar. 3, 1975. A plurality of sections 36 are hinged together by hinge means 38. Hinges 40 are joined to structure (to be hereinafter described) supported by the sidewalls 14 of the enclosure. A plurality of conductive members 42 each provide a continuous apex section with two substantially equidistant leg portions 46. The article to be prepared is disposed adjacent the free ends of the leg portions 46. The intense fringing electric field pattern provided in close proximity to the surfaces contacted of the article to be cooked provides for the searing and browning. The conductive members 42 may be of a lightweight metal such as aluminum.

In the cooking position the folding sections extend across the enclosure and are joined centrally by interlocking means 48, such as a bolt and eye arrangement or other suitable means. In the embodiment shown the bolt spans the adjacent ends of the sections 36 in the central joined position. Other fastening and securing means will be evident to those skilled in the art.

Figure 2:
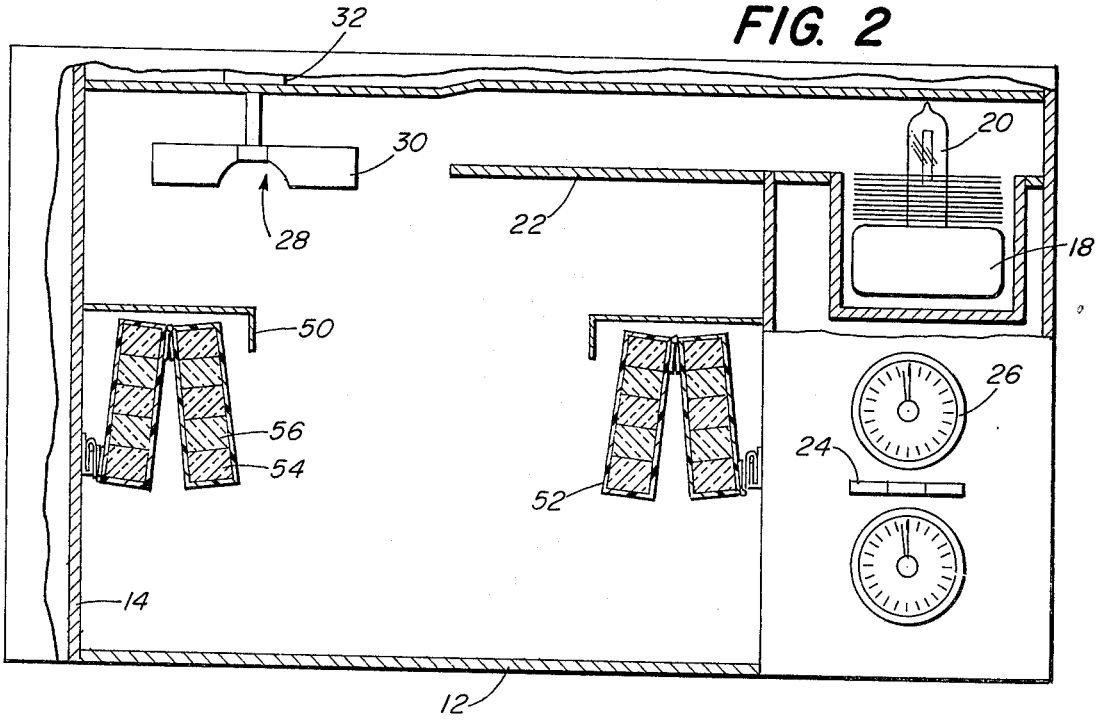
FIG. 2 is a vertical cross-sectional view of microwave apparatus embodying the invention in the folded or stored position.

Another feature of the invention resides in the retaining and shielding members 50 of a conductive material to house the folded sections and to reflect the microwave energy when the microwave oven apparatus is operative. Referring next to FIG. 2 the retractd and folded position of the microwave searing and browning means is illustrated. In this embodiment the sections 52 comprise alternate members of high and low dielectric constant material, 54, 56, respectively. The searing and browning means are illustrated in the retracted position within the shielding members 50. The embodiment shown represents the teachings of the referenced U.S. Pat. No. 3,857,009 in the provision of the alternating high and low dielectric constant members. The shielding members also prevent the energizing of the folded searing and browning means in the retracted and stored position as shown in FIG. 2.

Another feature of the invention resided in the provision for removal of the searing and browning means for cleaning. Referring again to FIG. 1, the hinges 40 are shown secured to a hook member 58 which overlaps and engages a channel member 60 secured to the oven enclosure walls 14. The structure may be readily removed for cleaning when necessary. Numerous other arrangements may be realized such as those providing for the snap in of the searing and browning means which will allow for rapid removal for cleaning.

There is thus disclosed browning and searing means which may be readily stored within the microwave oven apparatus and be available for use at any time. Numerous modifications will be evident to those skilled in the art. The foregoing description of a preferred embodiment is, therefore, intended to be interpreted broadly.

I claim:

1. Microwave oven apparatus comprising:

an enclosure;

means for radiating microwave energy within said enclosure; and means for heating and supporting an article within said enclosure to provide seared and browned exterior surfaces;

said heating and supporting means comprising a plurality of energy responsive members interconnected to form sections;

said sections being adapted to extend across said enclosure during the heating cycle and to be folded and stored during the nonheating cycle.

2. The apparatus according to claim 1 wherein conductive shielding members are provided within said enclosure to reflect energy impinging thereon and said folded heating means are stored in a position surrounded by said shielding members.

* * * * *